US006661713B1

(12) United States Patent
Kuo

(10) Patent No.: US 6,661,713 B1
(45) Date of Patent: Dec. 9, 2003

(54) BANDGAP REFERENCE CIRCUIT

(75) Inventor: Cheng-Hsiung Kuo, Tainan (TW)

(73) Assignee: Taiwan Semiconductor Manufacturing Company, Hsin-Chu (TW)

( * ) Notice: Subject to any disclaimer, the term of this patent is extended or adjusted under 35 U.S.C. 154(b) by 0 days.

(21) Appl. No.: 10/205,129

(22) Filed: Jul. 25, 2002

(51) Int. Cl.[7] ..... G05F 3/16

(52) U.S. Cl. ..... 365/189.09; 365/189.11; 327/539

(58) Field of Search ..... 365/189.09, 189.11; 323/314; 327/534, 538, 539

(56) References Cited

U.S. PATENT DOCUMENTS 4,857,823 A * 8/1989 Bitting ..... 323/314
5,323,278 A * 6/1994 Contreras et al. ..... 360/67
5,796,244 A 8/1998 Chen et al. ..... 323/313
5,900,773 A 5/1999 Susak ..... 327/539
6,150,872 A 11/2000 McNeill et al. ..... 327/539
6,204,724 B1 3/2001 Kobatake ..... 327/541
6,281,743 B1 8/2001 Doyle ..... 327/539

* cited by examiner

*Primary Examiner*—Vu A. Le
(74) *Attorney, Agent, or Firm*—George O. Saile; Stephen B. Ackerman

(57) ABSTRACT

This invention provides a circuit and a method for generating a bandgap reference voltage for integrated circuits. This invention relates to providing bandgap reference voltage which is temperature, process and power supply independent. In addition, this invention provides the ability to generate lower reference voltages which are compatible with the advances in integrated circuits. This invention utilizes the addition of additional resistance in the two differential input paths to provide a higher differential FET input gate voltage which will exceed the FET threshold voltage sufficiently to exceed and work with the Vbe voltages of the PN diodes which are implemented using bipolar junction transistors.

30 Claims, 2 Drawing Sheets

FIG. 1 – Prior Art

BANDGAP REFERENCE CIRCUIT

BACKGROUND OF THE INVENTION

1. Field of the Invention

This invention relates to a circuit and a method for generating a bandgap reference voltage for integrated circuits.

More particularly this invention relates to providing bandgap reference voltage which is temperature, process and power supply independent. In addition, this invention relates to the ability to generate lower reference voltages which are compatible with the advances in integrated circuits.

2. Description of Related Art

FIG. 1 shows a prior art bandgap reference circuit. A differential amplifier is made up of two p-channel metal oxide semiconductor field effect transistors PMOS FETs MP1 180 and MP2 150. It is also made up of the two n-channel metal oxide semiconductor FETs MN1 170 and MN2 160. Finally, the differential amplifier is made up of a current source 135 which connects to the common sources of the two NMOS FETs of the differential amplifier and sinks the current from them.

FIG. 1 also shows a first input path that drives the first differential input Vb 165. The first input path contains resistor R3 120 and PN diode Q2 130. PN diode Q2 130 is constructed from a PNP bipolar junction transistor, BJT, Q2 130. The BJT 130 has its base and collector tied in common to ground 140. The emitter of Q2 130 is tied to the resistor R3 120. In the prior art in FIG. 1, some implementations utilize multiple PN diodes in the first input path as represented by 145.

FIG. 1 also shows a second input path that drives the second differential input Va 175. The second input path contains PN diode Q1 125. PN diode Q1 125 is constructed from a PNP bipolar junction transistor, BJT, Q1 125. The BJT 125 has its base and collector tied in common to ground 140. The emitter of Q1 125 is tied to the input Va 175.

FIG. 1 also shows a first feedback path that contains a first feedback resistor, R2 110. This R2 resistor is connected between the first differential input Vb 165 and the differential output VBP 155.

FIG. 1 also shows a second feedback path that contains a second feedback resistor, R1 115. This R1 resistor is connected between the second differential input Va 175 and the differential output VBP 155.

FIG. 1 also shows a third PMOS FET, MP3 190. This device is used to drive the differential output VBP 155. Also, the PMOS FET, MP3 190 is used to isolate the differential output VBP 155 from the internal differential amplifier node 171. MP2 150 and MP1 180 are a current mirror. They are uses as the active load of MN2 160 and MN1 170.

U.S. Pat. No. 6,281,743 B1 (Doyle) "Low Supply Voltage Sub-Bandgap Reference Circuit " describes a reference circuit which results in a reference voltage which is smaller than the bandgap voltage of silicon. The circuit is temperature compensated.

U.S. Pat. No. 6,204,724 (Kobatake) "Reference Voltage Generation Circuit Providing a Stable Output Voltage" discloses a reference voltage generation circuit which utilizes two current mirrors circuits. This invention produces a stable output voltage.

U.S. Pat. No. 5,796,244 (Chen, et al.) "Bandgap Reference Circuit" discloses a voltage reference circuit, which is incorporated within an integrated circuit and which minimizes currents into the substrate.

U.S. Pat. No. 5,900,773 (Susak) "Precision Bandgap Reference Circuit" discloses a precision bandgap reference circuit. The circuit has an output stage which is biased with Proportional To Absolute Temperature (PTAT) current which is well controlled.

U.S. Pat. No. 6,150,872 (McNeill, et al.) "CMOS Bandgap Voltage Reference" discloses a bandgap reference circuit, which uses Proportional To Absolute Temperature (PTAT) voltage. The circuit can generate voltages below 1.24 volts. The invention utilized a start-up circuit to force the reference circuit into a known state.

BRIEF SUMMARY OF THE INVENTION

It is the objective of this invention to provide a circuit and a method for generating a bandgap reference voltage.

It is further an object of this invention to provide a bandgap reference circuit and method which provide a stable bandgap reference voltage which is immune to temperature, process and power supply variations.

It is further an object of this invention to provide the ability to generate lower reference voltages which are compatible with the advances in integrated circuits.

The objects of this invention are achieved by a bandgap reference circuit made up of a differential amplifier whose two inputs are compared to produce a difference signal and whose output is fed back to two input resistors of different values, a first differential input path which contains a first input bias resistance one end of which is connected to the first differential input, the other end of this first bias resistance is connected to the P-side of a first diode whose N-side is connected to ground, a second differential input path which contains a second input bias resistance one end of which is connected to the second differential input, the other end of this second bias resistance is connected to the P-side of a second diode whose N-side is connected to ground, a path parallel to said second differential input path which contains a capacitor connected between the second differential input and ground, a first feedback path from the differential output to a first feedback resistor whose other side is connected to said first differential input, a second feedback path from the differential output to a second feedback resistor whose other side is connected to the second differential input, and a differential output node which is driven by an MOS FET.

The bandgap reference circuits differential amplifier contains two P-channel metal oxide semiconductor P-MOSFET devices whose sources are connected to the Vdd supply voltage and are used as load devices and for current mirroring, two NMOS FETs whose inputs are connected to the two inputs which are to be compared, and a current source whose constant current flows from the commonly connected sources of said two NMOS FETs to ground. The bandgap reference circuit's first differential input path contains a first bias resistance which is composed of two series connected parts, a constant part and a variable part. The bandgap reference circuit's variable part of the first input bias resistance is a function of the resistance of the first feedback path. The bandgap reference circuits second differential input path contains a second bias resistance which is composed of two series connected parts, a constant part and a variable part.

The bandgap reference circuit's variable part of the second input bias resistance is a function of the resistance of the second feedback path. The bandgap reference circuit's path parallel to the second differential input path which contains a capacitor C which is connected between the second differential input and ground. The bandgap reference circuit's first feedback path contains a first feedback resistance. The bandgap reference circuit's first feedback resistance has a design value which is a function of said variable component of the first input bias resistance. The bandgap reference circuit's second feedback path contains a second feedback resistance. The bandgap reference circuit's second feedback resistance has a design value which is a function of the variable component of the second input bias resistance. The bandgap reference circuit's differential output is driven by a third PMOS FET device.

DETAILED DESCRIPTION OF THE INVENTION

Figure 2:
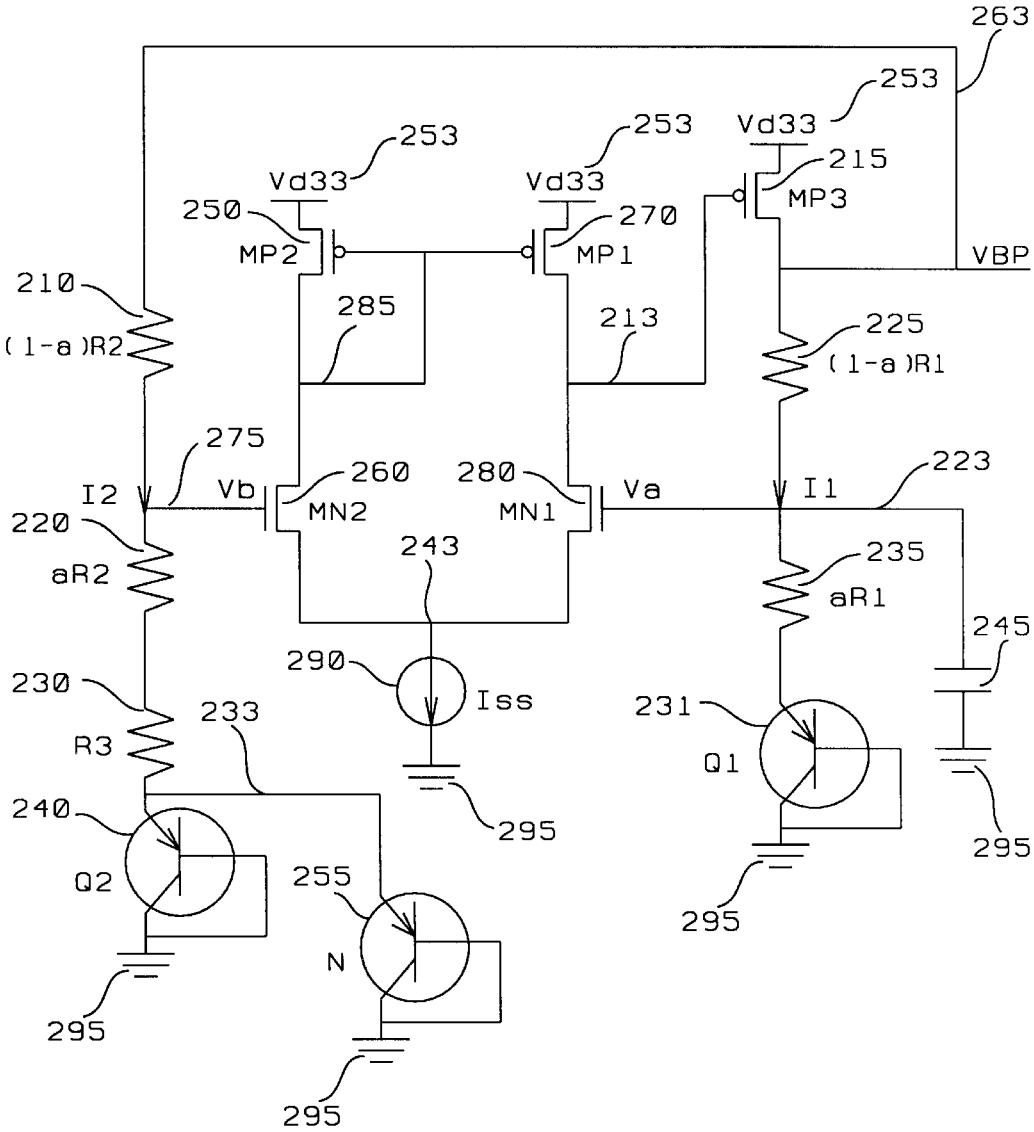
FIG. 2 gives a bandgap reference circuit diagram which illustrates the main embodiment of this invention.

FIG. 2 shows an embodiment of the bandgap reference circuit of this invention. A differential amplifier is made up of two p-channel metal oxide semiconductor field effect transistors PMOS FETs MP1 270 and MP2 250. It is also made up of the two n-channel metal oxide semiconductor FETs MN1 280 and MN2 260. Finally, the differential amplifier is made up of a current source 290 which connects to the common sources of the two NMOS FETs of the differential amplifier and sinks the current from them.

FIG. 2 also shows a first input path that drives the first differential input Vb 275. The first input path contains resistor R3 230 and PN diode Q2 240. PN diode Q2 240 is constructed from a PNP bipolar junction transistor, BJT, Q2 240. The BJT 240 has its base and collector tied in common to ground 295. The emitter of Q2 240 is tied to the resistor R3 230. As is illustrated in FIG. 2, some implementations utilize multiple PN diodes in the first input path as represented by 255. The first input path also contains resistor aR2 220 which is connected between resistor R3 230 and the first differential input 275.

FIG. 2 also shows a second input path that drives the second differential input Va 223. The second input path contains PN diode Q1 231. PN diode Q1 231 is constructed from a PNP bipolar junction transistor, BJT, Q1 231. The BJT 231 has its base and collector tied in common to ground 295. The emitter of Q1 231 is tied to the input Va 223. The second input path also contains resistor aR1 235 connected between the emitter of Q1 231 and the second differential input 223.

FIG. 2 also shows a first feedback path that contains a first feedback resistor, (1−a)R2 210. This (1−a)R2 resistor is connected between the first differential input Vb 275 and the differential output VBP 265.

FIG. 2 also shows a second feedback path that contains a second feedback resistor, (1−a)R1 225. This (1−a)R1 resistor is connected between the second differential input Va 223 and the differential output VBP 265.

FIG. 2 also shows a third PMOS FET, MP3 215. This device is used to drive the differential output VBP 265. Also, the PMOS FET, MP3 215 is used to isolate the differential output VBP 265 from the internal differential amplifier node 213.

Figure 1:
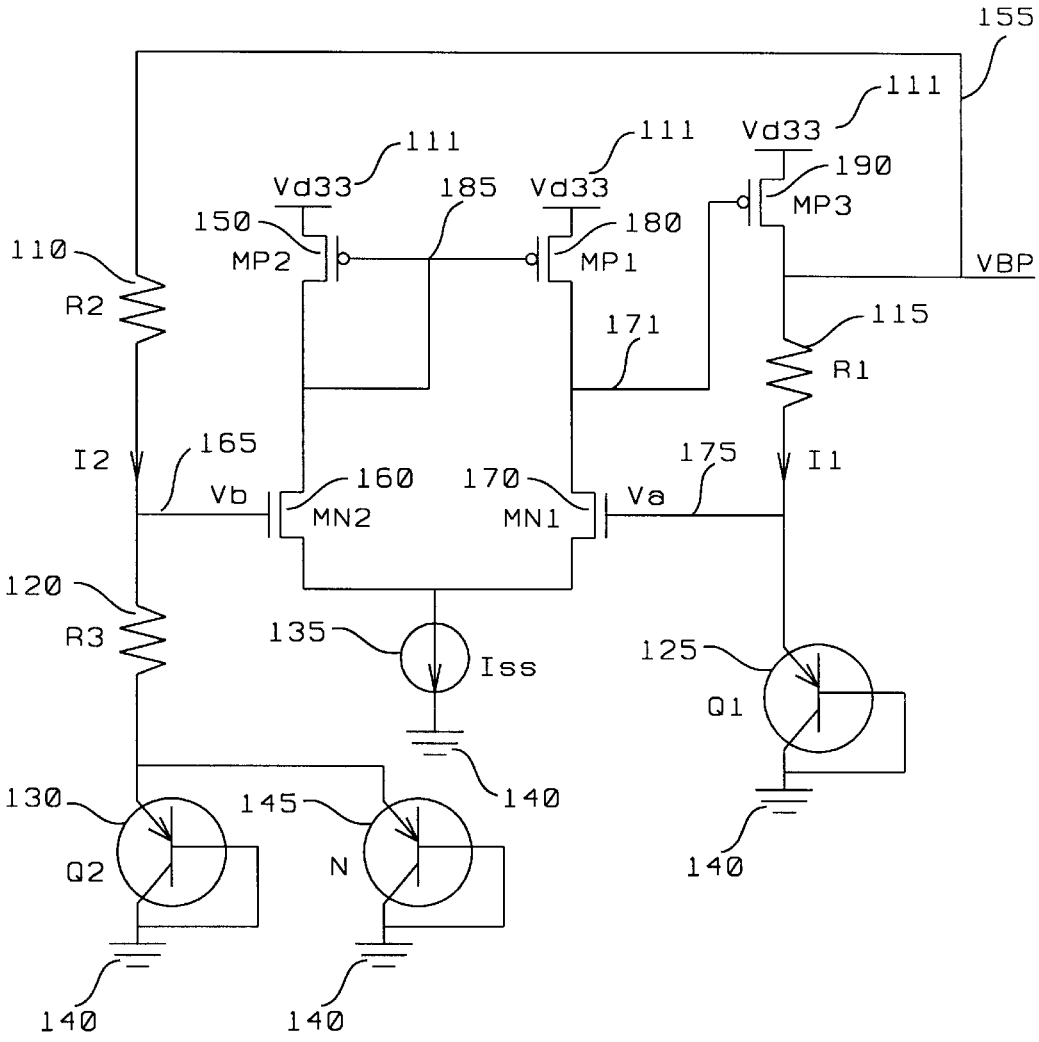
FIG. 1 shows a prior art bandgap reference circuit diagram.

The threshold voltage, Vth of 2.5 volt and 3.3 volt devices are 0.55 volt and 0.62 volt respectively. Q1 125 and Q2 130 in FIG. 1 are bipolar transistors whose base-emitter voltage drop, VEB is around 0.56 volt at high temperature. In FIG. 1, in the prior art, therefore, it is difficult to turn ON MN1 170 and MN2 160 at high temperature because the Vth of these two devices, Vth, is larger than VEB of the bipolar transistors, Q1 and Q2.

In FIG. 2 which shows the main embodiment of this invention, it is easy to turn ON MN1 280 and MN2 260 at higher temperatures. This is true since this invention uses two resistors, aR2 220 and aR1 235 to raise the voltage level of the first and second differential inputs, Vb and Va by I*aR where (0<a<1). Therefore, the voltage level of Va 223 and Vb 275 is VEB+I *aR which is larger than Vth of MN2 260 and MN1 280.

Below is a derivation of the output voltage produced by the bandgap reference circuit of this invention. The derivation can be followed by referring to the devices in FIG. 2.

Assume $R1=R2=R$ and $0<a<1$ $Va=Vb$ and $I1=I2$

Then $Va1=Vb1=VEB1$ $$VEB1-VEB2=Vt*In\{[N*(1-a)R\ 1]/(1-a)R2\}=Vt*In\ N$$

$$I1=I2=(Vb1-VEB2)/R3=(VEB\ 1-VEB2)/R3=(Vt*In\ N)/R3$$

$$VBP=I1*(1-a)R1+(I1*aR\ 1)+VEB1=VEB1+(I1*R\ 1)=VEB1+(R1/R3)*(Vt*InN)$$

The advantage of this invention is the use of extra resistors in the two differential input paths. These added resistors allow the circuit of the invention to easily turn ON MN1 and MN2 at higher temperatures.

While this invention has been particularly shown and described with Reference to the preferred embodiments thereof, it will be understood by those Skilled in the art that various changes in form and details may be made without Departing from the spirit and scope of this invention.

What is claimed is:

1. A bandgap reference circuit comprising:

a differential amplifier whose two inputs are compared to produce a difference signal and whose output is fed back to two input resistors of different values;

a first input bias resistor, one end of which is connected to a first differential input, the other end of which is connected to a P-side of a first diode, whose N-side is connected to ground;

a second input bias resistor, one end of which is connected to a second differential input, the other end of which is connected to a third input bias resistor, wherein said second input bias resistor is used to raise the voltage level of said first differential input;

wherein said third input bias resistor, one end of which is connected to said second input bias resistor and whose other end is connected to a P-side of a second diode or multiple diodes whose N-side is connected to ground;

a first differential input path which contains said first input bias resistance connected to said first differential input;

a second differential input path which contains said second input bias resistance connected to said second differential input;

a path parallel to said first differential input path which contains a capacitor connected between said first differential input and ground, a first feedback path from the differential output to a first feedback resistor whose other side is connected to said first differential input, a second feedback path from the differential output to a second feedback resistor whose other side is connected to said second differential input, and a differential output node which is driven by an MOS FET.

2. The bandgap reference circuit of claim 1 wherein said differential amplifier contains two P-channel metal oxide semiconductor P-MOSFET devices whose sources are connected to the Vdd supply voltage and are used as load devices and for current mirroring, two NMOS FETs whose inputs are connected to the two inputs which are to be compared, and a current source whose constant current flows from the commonly connected sources of said two NMOS FETs to ground.

3. The bandgap reference circuit of claim 1 wherein said first differential input path contains two series resistors, said first bias resistor and said first feedback resistor.

4. The bandgap reference circuit of claim 3 wherein said first bias resistor has a value 'a' times 'R' and said first feedback resistor has a value '1−a' times 'R' wherein 'a' is a number between 0 and 1 and wherein 'R' is a finite resistance.

5. The bandgap reference circuit of claim 1 wherein said second differential input path contains two series resistors, said second bias resistor and said second feedback resistor.

6. The bandgap reference circuit of claim 5 wherein said second bias resistor has a value 'a' times 'R' and said second feedback resistor has a value '1−a' times 'R' wherein 'a' is a number between 0 and 1 and wherein 'R' is a finite resistance.

7. The bandgap reference circuit of claim 1 wherein said path parallel to said first differential input path which contains a compensation capacitor whose capacitance is C connected between said first differential input and ground in order to prevent oscillation.

8. The bandgap reference circuit of claim 1 wherein said differential output is driven by a third PMOS FET device.

9. The bandgap reference circuit of claim 2 wherein said first PMOS FET has its source connected to supply voltage, Vdd, has its gate connected to its drain which is connected to the drain of said first input NMOS FET, and whose gate is connected in common with the gate of said second PMOS FET.

10. The bandgap reference circuit of claim 2 wherein said second PMOS FET has its source connected to supply voltage, Vdd, has its gate connected in common to said gate of said first PMOS FET, its drain is connected to the gate of said third PMOS FET which drives the differential output node.

11. The bandgap reference circuit of claim 2 wherein said first NMOS FET has its drain connected to the drain of said first PMOS FET, has its gate connected to said first differential input, and its source is connected to a differential amplifier current source.

12. The bandgap reference circuit of claim 2 wherein said second NMOS FET has its drain connected to the drain of said second PMOS FET, has its gate connected to said second differential input, and its source is connected to a differential amplifier current source.

13. The bandgap reference circuit of claim 12 wherein said differential amplifier current source is configured to sink current from the sources of said first and second NMOS FETs to ground.

14. The bandgap reference circuit of claim 1 wherein said second differential input path contains two series resistors, said second and third input bias resistors connected from said second differential input to one or several PN diodes whose N-sides are connected to ground and whose multiple PN diodes in only one side generate a different Vbe from the other side so that a delta Vbe is defined as follows $$\text{Delta } Vbe = Vbe1 - Vbe2.$$

15. The bandgap reference circuit of claim 1 wherein said first differential input path contains a resistance connected from said first differential input to said first PN diode whose N-side is connected to ground.

16. The bandgap reference circuit of claim 1 wherein said first feedback path contains said first feedback resistance which is connected between said differential output and said first differential input.

17. The bandgap reference circuit of claim 1 wherein said second feedback path contains said second feedback resistance which is connected between said differential output and said second differential input.

18. The bandgap reference circuit of claim 1 wherein said differential output is driven by a third PMOS FET device which is a current mirror of said first PMOS FET in said differential amplifier.

19. A method of building a bandgap reference circuit comprising the steps of:

including a differential amplifier whose two inputs are compared to produce a difference signal and whose output is fed back to two input resistors of different values;

including a first input bias resistor, one end of which is connected to a first differential input, the other end of which is connected to a P-side of a first diode, whose N-side is connected to ground;

including a second input bias resistor, one end of which is connected to a second differential input, the other end of which is connected to a third input bias resistor, wherein said second input bias resistor is used to raise the voltage level of said first differential input;

wherein said third input bias resistor, one end of which is connected to said second input bias resistor and whose other end is connected to a P-side of a second diode or multiple diodes whose N-side is connected to ground;

including a first differential input path which contains said first input bias resistance connected to said first differential input;

including a second differential input path which contains said second input bias resistance connected to said second differential input;

including a path parallel to said first differential input path which contains a capacitor connected between said first differential input and ground, including a first feedback path from the differential output to a first feedback resistor whose other side is connected to said first differential input, including a second feedback path from the differential output to a second feedback resistor whose other side is connected to said second differential input, and including a differential output node which is driven by an MOS FET.

20. The method of building a bandgap reference circuit of claim 19 wherein said differential amplifier contains two P-channel metal oxide semiconductor P-MOSFET devices whose sources are connected to the Vdd supply voltage and are used as load devices and for current mirroring, two NMOS FETs whose inputs are connected to the two inputs which are to be compared, and a current source whose constant current flows from the commonly connected sources of said two NMOS FETs to ground.

21. The method of building a bandgap reference circuit of claim 19 wherein said first differential input path contains two series resistor, said first bias resistor and said first feedback resistor.

22. The method of building a bandgap reference circuit of claim 21 wherein said first bias resistor has a value 'a' times 'R' and said first feedback resistor has a value '1−a' time 'R' wherein 'a' is a number between 0 and 1 and wherein 'R' is a finite resistance.

23. The method of building a bandgap reference circuit of claim 19 wherein said second differential input path contains two series resistors, said second bias resistor and said second feedback resistor.

24. The method of building a bandgap reference circuit of claim 23 wherein said second bias resistor has a value 'a' times 'R' and said second feedback resistor has a value '1−a' times 'R' wherein 'a' is a number between 0 and 1 and wherein 'R' is a finite resistance.

25. The method of building a bandgap reference circuit of claim 19 wherein said path parallel to said first differential input path which contains capacitor whose capacitance is C connected between said first differential input and ground.

26. The method of building a bandgap reference circuit of claim 19 wherein said differential output is driven by a third PMOS FET device.

27. The bandgap reference circuit of claim 1 wherein there is said third input bias resistor, one end of which is connected to said second input bias resistor and whose other end is connected to a P-side of a second diode whose N-side is connected to ground.

28. The bandgap reference circuit of claim 1 wherein there is said third input bias resistor, one end of which is connected to said second input bias resistor and whose other end is connected to P-sides of two or more diodes whose N-sides are connected to ground.

29. The method of building a bandgap reference circuit of claim 19 wherein there is said third input bias resistor, one end of which is connected to said second input bias resistor and whose other end is connected to a P-side of a second diode whose N-side is connected to ground.

30. The method of building a bandgap reference circuit of claim 19 wherein there is said third input bias resistor, one end of which is connected to said second input bias resistor and whose other end is connected to P-sides of two or more diodes whose N-sides are connected to ground.

* * * * *